United States Patent [19]

Glaessgen et al.

[11] Patent Number: 4,693,474

[45] Date of Patent: Sep. 15, 1987

[54] GAMES RACKET

[75] Inventors: Herbert Glaessgen, Ulm-Wiblingen; Wolfgang Kleinheinz, Lindau, both of Fed. Rep. of Germany

[73] Assignee: Dunlop Limited a British Company, United Kingdom

[21] Appl. No.: 747,852

[22] Filed: Jun. 24, 1985

[30] Foreign Application Priority Data

Jun. 22, 1984 [DE] Fed. Rep. of Germany ..... 8418807

[51] Int. Cl.[4] ..... A63B 49/04

[52] U.S. Cl. ..... 273/73 C; 273/73 D

[58] Field of Search ..... 273/73 R, 73 C, 73 D, 273/63 E, 81 A, 194 B, 169, 171, 173, 167 F

[56] References Cited

U.S. PATENT DOCUMENTS

| | | | |
|---|---|---|---|
| 3,625,512 | 12/1971 | Latham et al. . | |
| 3,801,099 | 4/1974 | Lair . | |
| 3,913,911 | 10/1975 | Peterson | 273/73 C |
| 3,989,247 | 11/1976 | Zimmerman | 273/73 R |
| 4,008,896 | 2/1977 | Gordos | 273/171 |
| 4,153,249 | 5/1979 | Plagenhoef . | |

FOREIGN PATENT DOCUMENTS

| | | | |
|---|---|---|---|
| 848826 | 8/1970 | Canada | 273/73 C |
| 2010450 | 9/1971 | Fed. Rep. of Germany . | |
| 19398 | 10/1978 | Fed. Rep. of Germany . | |
| WO81/00214 | 2/1981 | PCT Int'l Appl. . | |
| 751040 | 6/1956 | United Kingdom | 273/73 C |

*Primary Examiner*—Richard C. Pinkham
*Assistant Examiner*—Matthew L. Schneider
*Attorney, Agent, or Firm*—Stevens, Davis, Miller & Mosher

[57] ABSTRACT

The invention relates to a games racket having a strung head and additional structure for adjusting the playing properties of the racket. Removable weights are attached to the circumference of the head by way of carrier members which are secured to the head in the region of the transverse axis through the center of percussion of the racket. The carrier members have recesses into which the weights can be inserted.

4 Claims, 7 Drawing Figures

GAMES RACKET

The invention relates to a games racket, e.g. for tennis or similar games, and is particularly concerned to provide means for the alteration or adjustment of the desired playing-properties of a games racket. Such means are known per se, for example from German Offenlegungsschrift No. 20 10 450, according to which a tennis-racket is provided with fixable weights, which are inserted into a slot provided on the racket profile and secured therein by screws.

According to another known means, namely German Offenlegungsschrift No. 27 24 652, adjustment of a tennis racket to the playing requirements of the player is achieved by weights consisting of metal strips which are gripped on to the racket frame.

A further known means provides, in German Offenlegungsschrift No 27 19 649, a special frame profile for a tennis-racket, which consists of longitudinally-extending recesses for the pressing-in of pre-shaped weights. Thereby the weight-distribution and the centre of percussion of the racket can be fixed.

Also, there is known, from U.S. Pat. No. 3,801,099, a racket with a shorter head-axis and a longer transverse-axis. At the outer points of the greater axis there are attached, with screws, additional weights. Also, one obtains thereby an alteration of the moment of inertia of the racket.

All these known constructions have, on the one hand, the disadvantage that they are not usable on ready-made rackets, so that special racket constructions are necessary for such weights to be applied; moreover, these known constructions are for the most part used for other objectives.

The present invention is based upon the task of providing a means by which it is possible to alter the moment of inertia of a racket, without thereby altering the site of the centre of percussion. At the same time the means according to the invention can be so constructed that a special construction of frame is superfluous. The means according to the invention should be attachable many times in each frame.

Thus, by means of the present invention, starting from a known construction of a games racket having a frame comprising a handle and a head for stringing, one or more weights are removably attached at one or more places on the racket frame.

Accordingly the invention provides in one aspect a games racket having adjustable playing properties, the racket having a frame comprising a head and a handle, the head being adapted to carry the desired stringing and the frame having one or more weights removably attached at one or more positions on the inner or outer circumference of the head by means of carrier members secured to the head in the region of the transverse axis extending through the centre of percussion of the racket, the carrier members being provided with recesses into which the weights are inserted.

In another aspect the invention provides means to adjust the playing properties of a games racket of the type comprising a head adapted for stringing, the means comprising one or more carrier members adapted to be attached to the inner or outer circumference of the head of the racket in the region of the transverse axis extending through the centre of percussion of the racket, the carrier members being provided with recesses into which weights can be inserted.

With such an arrangement, which is applicable to any frame for a tennis or similar racket, it is achieved that the position of the centre of percussion remains unaltered, even if, by alteration of the weights, a greater impact-energy is obtained.

For putting into practice the invention there are several possibilities.

Thus, one can provide the string-protecting grommets of the frame head, in the region of the carrier members, with rebates for the attachement of these carrier members. These grommets then have a greater length than is customary for the bearing-head of previously-available grommets.

The carrier members themselves can be attached in various ways to the frame. It is recommended that these carrier members are of claw-shaped construction and are insertable and attachable to the inner or outer side of the frame.

The weights which are insertable into the carrier members suitably comprise balls of a material of high specific gravity (e.g. steel or lead); the carrier members themselves are provided with hollow ball-shaped recesses corresponding to the diameter of the balls so as to enclose more than half the surface of the inserted balls.

It is further recommended that these hollow ball-shaped recesses in the carrier members are so constructed that the plane of their openings extends approximately at right angles to the stringing plane of the racket head.

Thus it may be decided from the outset, and is a basic feature of the invention, that a single type of racket may be made and the adjustment of this racket for the type of game and physical characteristics of the player is so carried out, that the centre of percussion remains unaltered.

According to one embodiment, string-protecting grommets are provided on both sides of the plane of the centre of gravity of the frame, which grommets are longer than the customary grommets and are provided with rebates for the attachment of the carrier members. If it is now required to make a single type of tennis racket, then all frame heads can be equipped in this way with the special grommets, in the plane of the centre of percussion. If these grommets are not used, because such a racket has to be left in its original form, then the grommets are applied only on one part of the inner side, whereupon the stringing of the racket head can be undertaken.

The invention is illustrated by way of example only by reference to the accompanying drawings in which.

Figure 1:
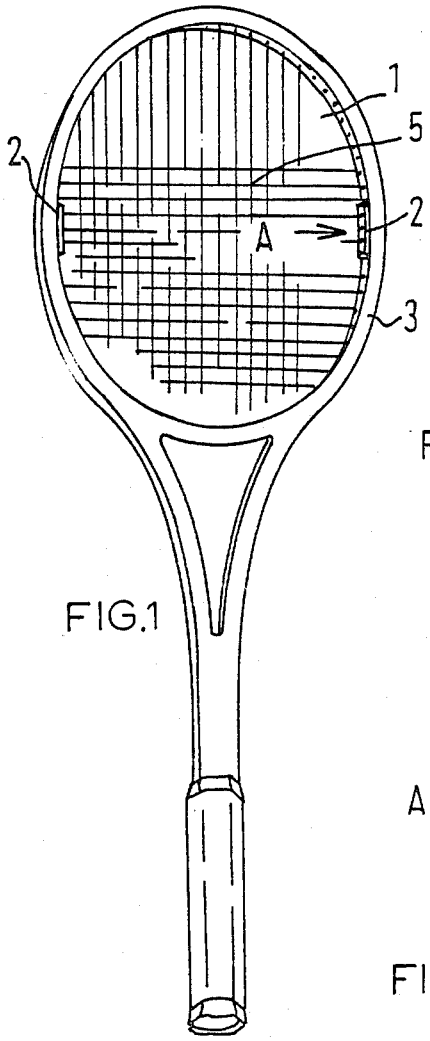
FIG. 1 is a tennis-racket in schematic perspective view, the racket head having attached to it the adjustment means of the invention.
Figure 2:
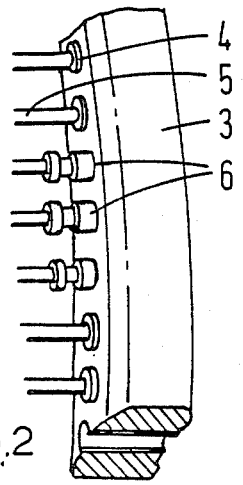
FIG. 2 is a fragmentary view in enlarged form of a portion of the head of the racket of FIG. 1 from which the carrier member for the adjustment means has been removed.
Figure 3:
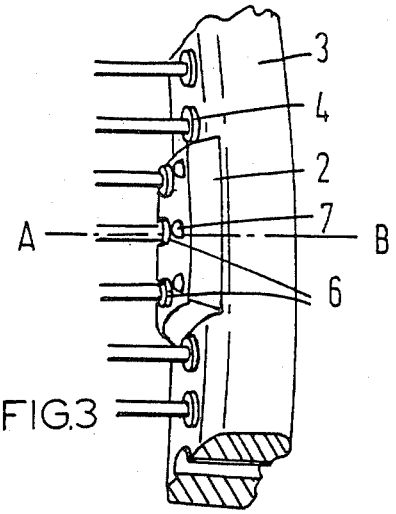
FIG. 3 is a similar view of FIG. 2 but showing the carrier member for the adjustment means in position.
Figure 4:
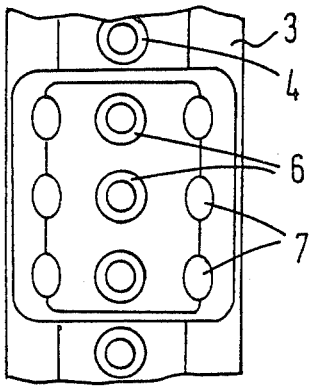
FIG. 4 is a plan view along arrow A of FIG. 1.
Figure 5:
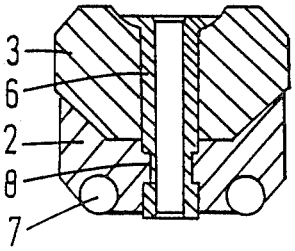
FIG. 5 is a section on line A–B of FIG. 3.

Referring to FIGS. 1 to 3, the racket head 1 has a frame 3 and stringing 5. The strings 5 are attached to the head of the frame by use of string-protecting grommets 4. Two carrier members 2 are now fixed approximately in the plane of the centre of percussion of the racket, one at each side of the head on its inner periphery. These carriers serve for the reception of insertable weights 7. These carrier members 2 are, in the embodiments shown in FIGS. 1 to 5, secured to the frame 3 by the use of elongated grommets 6. To this end the grommets 6 are provided with an annular groove 8 (as shown in FIG. 5) into which the carrier member 2 is inserted and thereby is secured to the frame. In this embodiment the carrier member 2 is provided with six recesses, which serve to receive a maximum of six balls 7.

Figure 6:
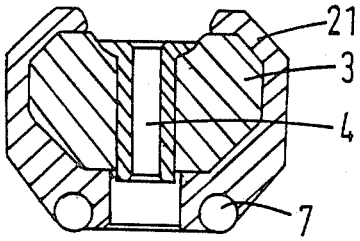
FIG. 6 is a similar view of FIG. 5 but showing an alternative embodiment of the invention.

In the cross-sectional drawing of FIG. 6 there is shown an alternative embodiment for the attachment of carrier member 21 on to frame profile 3. This carrier member 21 is claw-shaped and this serves to allow it to be snapped on to the inside of the frame profile. In this case the specially constructed, elongated string-protecting grommets are not required.

Figure 7:
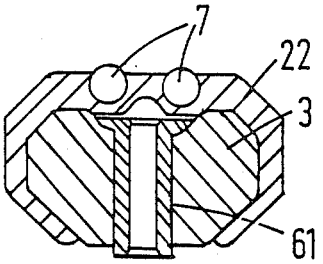
FIG. 7 is also a similar view to FIG. 5 but showing another alternative embodiment of the invention.

In the further embodiment shown in the cross-sectional drawing of FIG. 7, there is illustrated a carrier member 22 which is attached on the outside of the frame and held thereto thanks to its claw-shaped construction.

The advantage of this embodiment consists in that these carrier members can even be attached after the stringing of the frame. Moreover, with this type of attachment of the carrier member 22 there is no intrusion into the frame surface; the entire frame surface is left as a playing surface.

What is claimed is:

1. In a games racket having adjustable playing properties, said racket having a frame comprising a head for stringing and a handle; said frame having at least one weight removably attached thereto at least one position on the circumference thereof, the improvement which comprises at least one carrier member secured to said head at a position corresponding to the transverse axis extending through the center of percussion of said racket, each said carrier member having recesses to receive said weights; said frame including string-protecting grommets some of which are extended in length, said extended grommets having circumferential recesses to receive said carrier members.

2. The games racket of claim 1, wherein each said carrier member is claw-shaped and attachable on to the inner or outer circumference of said frame.

3. The games racket of claim 1, wherein said weights consist of balls of a material of high specific gravity and the recesses in said carrier members are of hollow ball-shaped and correspond to the diameter of the balls, whereby more than half of the surface of one of said balls can be enclosed in each said recess.

4. The games racket of claim 3, wherein said hollow ball-shaped recesses in said carrier members are so arranged that the plane of their openings extends approximately at right angles to the stringing plane of said racket head.

* * * * *